US008708062B2

(12) United States Patent
Lamprecht

(10) Patent No.: US 8,708,062 B2
(45) Date of Patent: Apr. 29, 2014

(54) MACHINE TOOL, IN PARTICULAR A HANDHELD POWER TOOL

(75) Inventor: Justus Lamprecht, Dusslingen (DE)

(73) Assignee: Robert Bosch GmbH, Stuttgart (DE)

( * ) Notice: Subject to any disclaimer, the term of this patent is extended or adjusted under 35 U.S.C. 154(b) by 315 days.

(21) Appl. No.: 12/736,501

(22) PCT Filed: Mar. 24, 2009

(86) PCT No.: PCT/EP2009/053441

§ 371 (c)(1),
(2), (4) Date: Oct. 14, 2010

(87) PCT Pub. No.: WO2009/127501

PCT Pub. Date: Oct. 22, 2009

(65) Prior Publication Data

US 2011/0024147 A1 Feb. 3, 2011

(30) Foreign Application Priority Data

Apr. 18, 2008 (DE) ..... 10-2008-001-252

(51) Int. Cl.
*B25F 5/02* (2006.01)

(52) U.S. Cl.
USPC ..... 173/217; 173/162.2; 173/170; 451/358

(58) Field of Classification Search
USPC ..... 173/170, 217, 210, 211, 162.2, 162.1, 173/171; 451/358, 359; 30/392, 517
See application file for complete search history.

(56) References Cited

U.S. PATENT DOCUMENTS

| | | | | |
|---|---|---|---|---|
| 2,946,315 | A | 7/1960 | Doeden | |
| 4,434,586 | A * | 3/1984 | Muller et al. | 451/358 |
| 4,980,994 | A * | 1/1991 | Helm et al. | 451/342 |
| 5,201,146 | A | 4/1993 | Fushiya | |
| 5,466,183 | A * | 11/1995 | Kirn et al. | 451/359 |
| 5,681,214 | A * | 10/1997 | Kleider et al. | 451/358 |
| 5,692,574 | A * | 12/1997 | Terada | 173/162.2 |
| 6,179,512 | B1 * | 1/2001 | Gibson et al. | 403/374.1 |
| 6,244,947 | B1 * | 6/2001 | Van Osenbruggen | 451/359 |
| 6,327,961 | B1 * | 12/2001 | Rozek | 92/140 |
| 6,912,790 | B2 * | 7/2005 | James et al. | 30/392 |
| 7,204,744 | B2 * | 4/2007 | Lamprecht et al. | 451/357 |
| 7,217,178 | B2 * | 5/2007 | Oki et al. | 451/359 |
| 7,397,153 | B2 * | 7/2008 | Buck et al. | 310/50 |
| 7,537,065 | B2 * | 5/2009 | Gallagher et al. | 173/170 |
| 7,721,818 | B2 * | 5/2010 | Inagawa et al. | 173/162.2 |
| 8,006,778 | B2 * | 8/2011 | Wiker et al. | 173/162.2 |

FOREIGN PATENT DOCUMENTS

| | | | |
|---|---|---|---|
| DE | 31 14 906 | A1 | 10/1982 |
| DE | 3901728 | A1 | 7/1990 |
| EP | 0493033 | A1 | 7/1992 |
| EP | 1327497 | A2 | 7/2003 |
| EP | 2 374 578 | A2 | 10/2011 |
| SU | 655030 | A1 | 3/1979 |
| SU | 1105982 | A1 | 7/1984 |
| WO | WO 2009068342 | A1 * | 6/2009 |

* cited by examiner

*Primary Examiner* — Scott A. Smith
(74) *Attorney, Agent, or Firm* — Maginot, Moore & Beck

(57) ABSTRACT

The invention relates to a machine tool having a two-part housing. The housing parts of the machine tool are connected by a connection device that has at least two connection projections. According to the invention, the connection projections in one housing part are arranged adjacent to each other and engage in corresponding connection recesses, in a positive fit, arranged in the other housing part.

19 Claims, 3 Drawing Sheets

MACHINE TOOL, IN PARTICULAR A HANDHELD POWER TOOL

CROSS-REFERENCE TO RELATED APPLICATION

This application is a 35 U.S.C. 371 application of PCT/EP2009/053441 filed on Mar. 24, 2009.

BACKGROUND OF THE INVENTION

1. Field of the Invention

The invention relates to a machine tool, in particular a handheld power tool, which has a housing for receiving and mounting both a drive unit and a tool, in which the housing has two separate housing parts which are connected to one another via a connecting device.

2. Description of the Prior Art

Handheld power-tools driven by electric motor are known, such as drills, angle grinders, saws, or the like, which have as their drive an electric motor that is disposed in a motor housing and whose driving motion is transmitted to a drive shaft with a tool disposed on it. Grip elements are connected to the motor housing and are embodied as separate components, and the user holds the handheld power tool by these grip elements. The grip for instance comprises two grip half-shells, on each of which, to make the connection with the motor housing, an annular, radially inward-oriented connection projection is disposed, which protrudes into an associated annular gap on the motor housing.

In general, in making a connection between the various housing parts of a machine tool, care must be taken that forces and moments that occur in typical operation will also be absorbed over a long period of operation by the housing without interference. Thus in handheld power tools, for instance, not only forces in the longitudinal direction but bending moments between the various housing parts as well have to be transmitted. The connection between the housing parts must be capable of absorbing these forces and moments.

European Patent Disclosure EP 0 493 033 A1 shows a handheld power tool whose housing in two parts with a front housing part for receiving and mounting a drive unit 2 and with a rear housing part that forms the grip part. The two housing parts are connected to one another via a connecting device, which has two connection projections on the rear housing part and complementary connection recesses on the front housing part. There are two connection projections and two connection recesses each, which are located one after the other in the connection and release direction, which at the same time is the longitudinal axis of the handheld power tool. The connection projections have a rectangular cross section, as do the connection recesses, and extend perpendicular to the connection and release direction.

Object and Advantages of the Invention

The object of the invention is to embody a machine tool, in particular a handheld power tool, with simple structural provisions in such a way that various housing parts can be connected to one another in a simple way, and at the same time a connection with which strong forces and moments can be transmitted is ensured.

The machine tool of the invention has a housing in at least two parts for receiving and mounting both the drive unit and the tool. The connecting device that holds the two housing parts together has at least two connection projections, which are located one after the other in the connection and release direction of the housing parts and which in form-locking fashion engage associated connection recesses in the other housing part. Because of the positioning in line with one another of the connection projections on one housing part, the forces to be transmitted via the connection, in comparison to conventional connecting devices, are distributed to the at least two projections and the associated recesses, so that the forces are cut at least in half. The reduction in the forces to be transmitted protects the housing material in the vicinity of the connection, so that it is fundamentally possible to use thinner housing walls. However, it is also possible for overall greater forces and moments to be transmitted between the housing parts without impermissible deformation. Overall, the forces and moments are distributed over a larger contact area between the housing parts. In general, the connection by means of the connecting device is made via a form lock, which is attained by the undercutting, operative in the connection and release direction of the housing parts, of the connection projections and connection recesses.

A further advantage of the multi-row connection projections is the increased safety in the event of an overload. If one connection projection fails, the connection function can be maintained by the second connection projection; this prevents the housing from breaking apart, or at least postpones it.

In a preferred embodiment, the connecting device is designed in such a way that a rotational capability between the connecting housing parts exists. The rotation takes place about the longitudinal axis of the machine tool, or in other words about the release and connection direction between the housing parts. Thus the connecting device is capable both of transmitting mounting forces in the connection direction and moreover of absorbing bending moments between the housing parts; at the same time, rotation between the housing parts is allowed, which enables and simplifies use by both right-handed and left-handed users. To achieve the rotation capability, the connection projections and the associated connection recesses are embodied identically in the circumferential direction. It may optionally be expedient to limit the rotation capability to a defined angular range, for instance by means of stops or the like.

It is also expedient to construct the at least two connection projections as intrinsically identical, that is, to provide them with the same cross section. On the one hand, this facilitates production; on the other, at least approximately equally strong forces are transmitted via the identical connection projections.

It is furthermore possible for the connection projections to extend over the entire length of the parting line between the housing parts to be connected. However, it is also possible for the parting line to be covered only partially in the circumferential direction. Moreover, the at least two connection projections can be embodied with either the same length or different lengths in the circumferential direction.

If no capability of relative rotation between the housing parts is wanted, then advantageously stops are provided between the housing parts; they may also optionally be disposed directly on the connecting device, for instance by means of radial engagement of a peg or the like with an associated recess. The stops prevent a relative rotation between the housing parts.

The connection projections are advantageously embodied in one piece with the housing parts. The connection recesses on the other housing part can also be embodied in one part with it, so that the form lock between the housing parts is attained by simply slipping them on axially.

Furthermore, however, an embodiment of the connection projections as a separate component is also possible, in particular by disposing the connection projections on a separate housing portion, which is to be connected to one of the housing parts via further, connection elements.

In a further advantageous embodiment, the connection projections have a tooth shape and expediently have an inclination that is opposite that of the release direction between the housing parts to be connected. In this way, greater connection forces can be transmitted between the housing parts. The tooth shape of the connection projections makes it possible on the one hand for the bending stress to be distributed uniformly over the entire connecting device, and on the other, slipping one housing part onto the other housing part is made easier, and the release of the housing parts is made more difficult, by the tapering to a point of the connecting teeth and by the inclination of the connecting teeth. The embodiment in tooth shape furthermore has the advantage of better compensation for play and tolerances.

In a further expedient embodiment, the base between the adjacent connection projections, that is, the transition from one connection projection to the next connection projection, is rounded, to avoid peak stresses that can cause component damage.

In a further advantageous embodiment, a damping element is integrated with the housing portion having the connection projections and the connection recesses, for instance by means of an undulating or bellowslike embodiment of the housing wall, which permits a longitudinal expansion and contraction in the connection and release direction and contributes, by way of the intrinsic damping of the material, to vibration damping. However, the embodiment of the damping element as a separate component, which is integrated with or secured to the wall of the housing portion of the connecting device, is also possible.

Further advantages and expedient embodiments can be learned from the further claims, the description of the drawings, and the drawings. In the drawings:

BRIEF DESCRIPTION OF THE DRAWINGS

In the drawings, identical components are provided with the same reference numerals.

DESCRIPTION OF THE PREFERRED EMBODIMENTS

Figure 1:
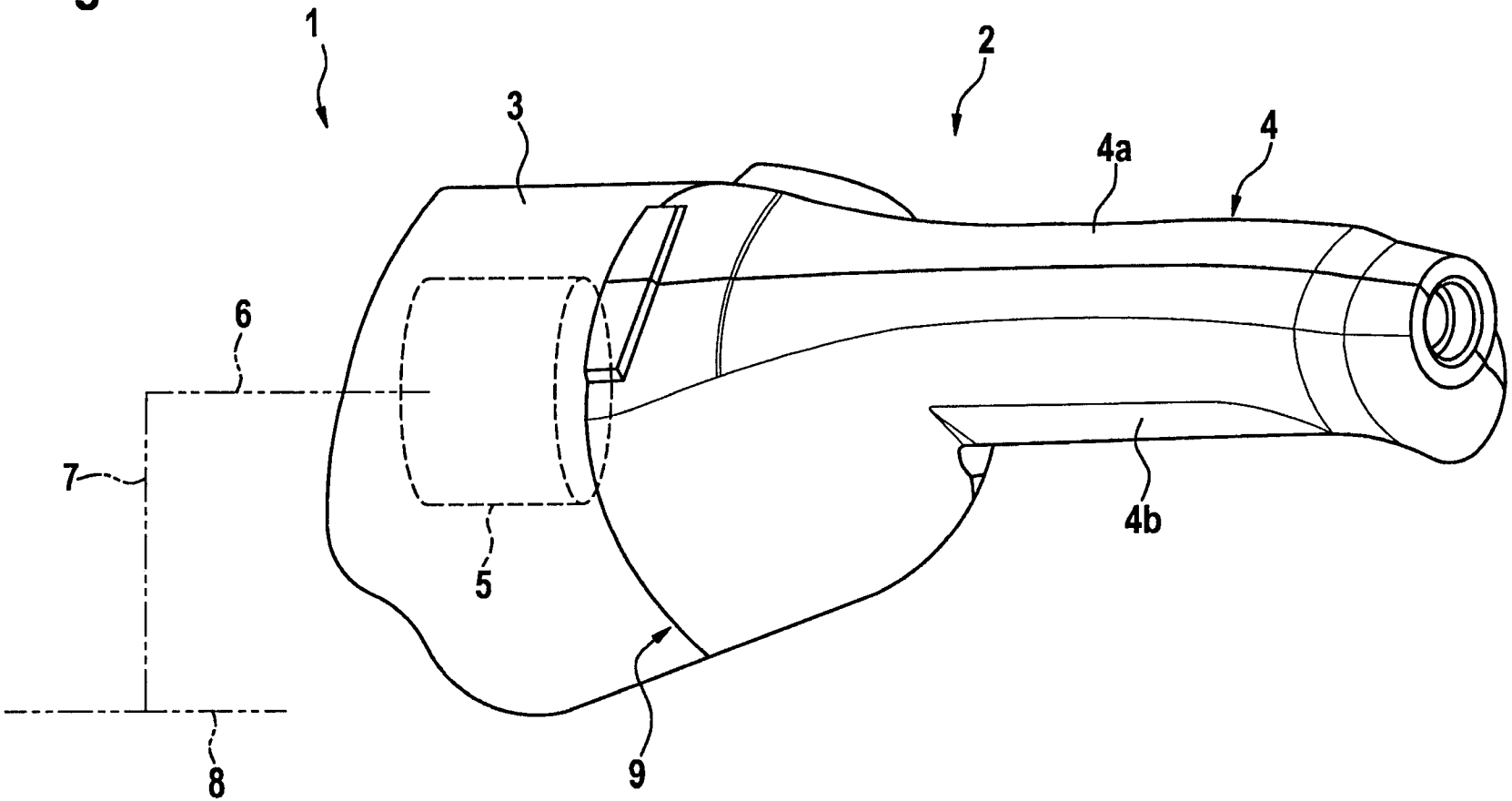
FIG. 1 shows a perspective view on a housing of a handheld power tool, comprising a motor housing and a grip housing.

The handheld power tool 1 shown in FIG. 1 has a housing 2, comprising a motor housing 3, with an electric drive motor 5 disposed in it, and a two-part grip housing 4, which is constructed of two grip half-shells 4*a* and 4*b*. The motor housing 3 and the grip housing 4 are connected to one another via a connecting device along a parting line. The driving motion of the drive motor 5 is transmitted via a drive connection 6, shown only schematically, to a drive shaft 7, which is the holder of a releasably securable tool 8, both also shown only schematically.

Figure 2:
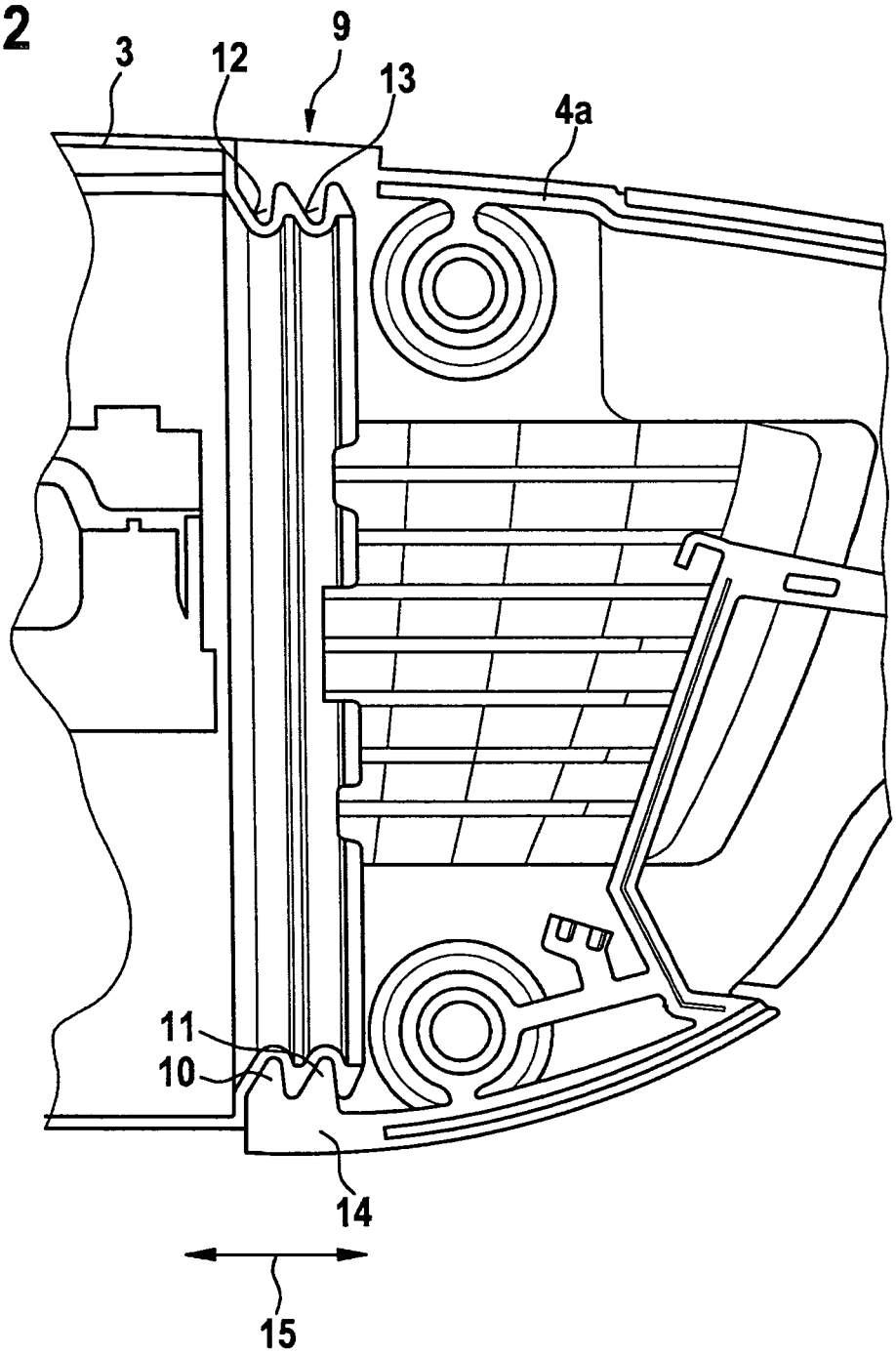
FIG. 2 shows a connecting device between the motor housing and the grip housing, comprising two tooth-shaped connection projections on the face end of one housing part, with the connection projections protruding into associated connection recesses on the other housing part.

As can be from FIG. 2, the connecting device 9, by way of which the motor housing 3 is to be connected to each grip, half-shell 4*a* and 4*b*, has two tooth-shaped connection projections 10 and 11, located in line with one another, which are disposed on a housing portion 14 and which extend radially inward, in terms of the connection and release direction 15 in which the housing parts are connected to one another and released from one another. The housing portion 14 is embodied in one piece with the wall of one housing part, and in the exemplary embodiment is in one piece with the grip half-shell 4*a*. The wall thickness of the housing portion 14 is equivalent to the wall thickness of the grip half-shell 4*a*. The radially extending tooth height, that is, the spacing between the tooth base between the two connection projections 10 and 11 and the respective tip, is at least approximately equivalent to the wall thickness of the housing portion 14.

Figure 3:
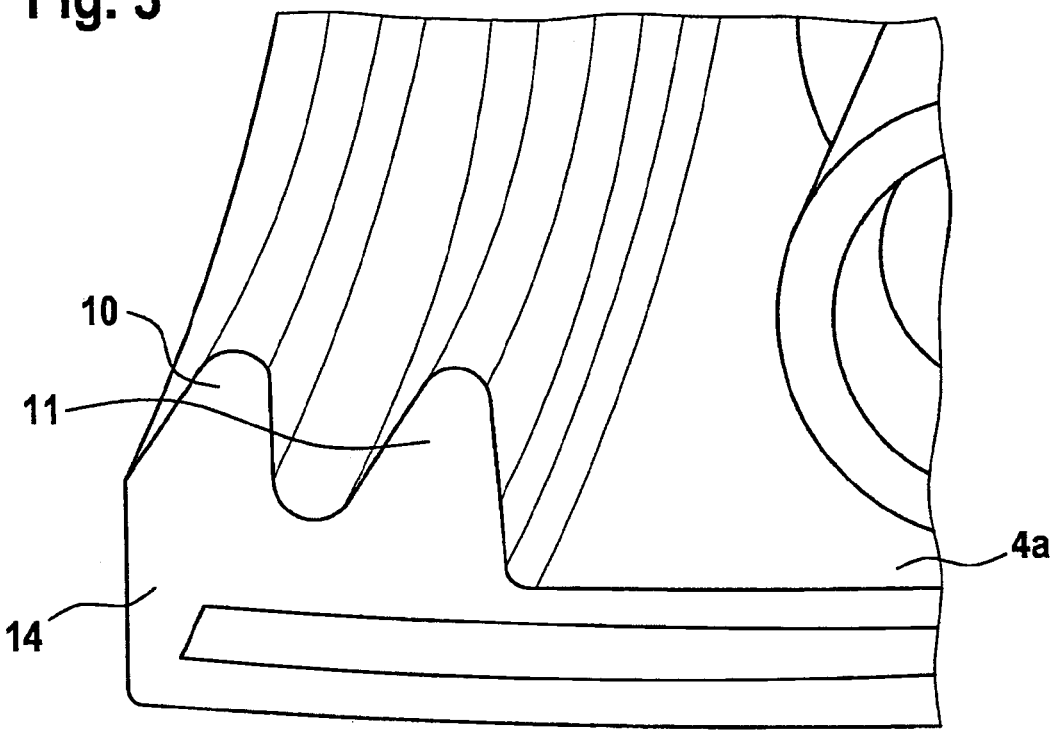
FIG. 3 shows a housing part with two tooth-shaped connection projections, disposed in line with one another, in an enlarged individual view.
Figure 4:
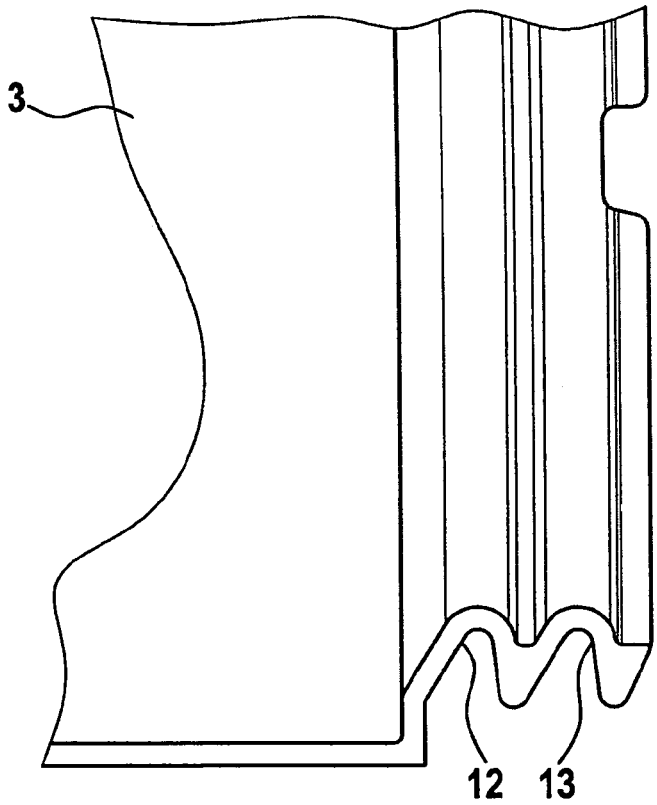
FIG. 4 shows the other housing part with associated connection recesses.

As can be seen from FIG. 2 in conjunction with FIGS. 3 and 4, in the connection position of the housing parts embodied by the motor housing 3 and the grip half-shell 4*a*, the tooth-shaped connection projections 10 and 11, which are made in the grip half-shell 4*a* protrude into associated, complementary connection recesses 12 and 13, which are made in the other housing part—that is, in the motor housing 3. Because of the complementary embodiment, in the connection position the connection projections are received without play in the associated recesses. The tooth-shaped connection projections have an oppositely oriented inclination relative to the release direction 15, so that greater connection forces can be transmitted in the release direction.

Because of the tooth shape, the cross section of the connection projections 10 and 11 tapers radially from the outside inward; the connection recesses 12 and 13 are correspondingly embodied in complementary fashion. The base (not enumerated) at the transition between the connection projections 10 and 11 that are adjacent and are located in line with one another in the axial or release direction, is provided with a rounded cross section, to avoid notch effects.

It may optionally be expedient to provide more than two connection projections located in line with one another in the connection and release direction, and to associate a number of connection recesses corresponding to the connection projections on the other housing part.

The foregoing related to the preferred exemplary embodiments of the invention, it being understood that other variants and embodiments thereof are possible within the spirit and scope of the invention, the latter being defined by the appended claims.

The invention claimed is:

1. A machine tool, comprising:

a housing configured to receive and mount a drive unit and a tool, the housing having two housing parts that are axially slidably connectable to and releasable from one another in respective connection and release directions; and a connecting device having at least two connection projections on one housing part that are disposed in line with one another in the connection and release directions, the connection projections engaging connection recesses defined by the other housing part to connect the housing parts in form-locking fashion, wherein the connection projections are embodied as connection teeth tapering to a point, and wherein at least one tooth-shaped connection projection and at least one portion of the housing part defining the connection recesses have respective first complementary inclinations that (i) facilitate slidable connection of the housing parts in the connection direction and (ii)

prevent relative axial movement between the housing parts in the connection direction once the housing parts are connected.

2. The machine tool as defined by claim 1, wherein at least one connection projection extends over an entire length of a parting line between the housing parts to be connected.

3. The machine tool as defined by claim 2, wherein the connection projections are constructed identically to one another.

4. The machine tool as defined by claim 3, wherein the connection projections are embodied in one piece with the one housing part.

5. The machine tool as defined by claim 3, wherein the connection projections are embodied in one piece with a housing portion of the one housing part.

6. The machine tool as defined by claim 3, wherein a transition between the connection projections is rounded.

7. The machine tool as defined by claim 3, wherein the housing parts connected via the connecting device are a motor housing and a grip housing.

8. The machine tool as defined by claim 2, wherein the connection projections are embodied in one piece with the one housing part.

9. The machine tool as defined by claim 2, wherein the connection projections are embodied in one piece with a housing portion of the one housing part.

10. The machine tool as defined by claim 1, wherein the connection projections are constructed identically to one another.

11. The machine tool as defined by claim 10, wherein the connection projections are embodied in one piece with the one housing part.

12. The machine tool as defined by claim 10, wherein the connection projections are embodied in one piece with a housing portion of the one housing part.

13. The machine tool as defined by claim 1, wherein the connection projections are embodied in one piece with the one housing part.

14. The machine tool as defined by claim 13, wherein the housing part that has the connection projections has a thickness which at least approximately corresponds to a height of the connection projections.

15. The machine tool as defined by claim 1, wherein the connection projections are embodied in one piece with a housing portion of the one housing part.

16. The machine tool as defined by claim 15, wherein the housing portion that has the connection projections has a thickness which at least approximately corresponds to a height of the connection projections.

17. The machine tool as defined by claim 1, wherein a transition between the connection projections is rounded.

18. The machine tool as defined by claim 1, wherein the housing parts connected via the connecting device are a motor housing and a grip housing.

19. The machine tool as defined by claim 1, wherein the at least one tooth-shaped connection projection and at least one further portion of the housing part defining the connection recesses have respective second complementary inclinations that (i) impede slidable release of the housing parts in the release direction and (ii) prevent relative axial movement of the housing parts in the release direction once the housing parts are connected.

* * * * *